US011767832B2

(12) United States Patent
Takei et al.

(10) Patent No.: US 11,767,832 B2
(45) Date of Patent: Sep. 26, 2023

(54) FLUID PRESSURE ROTATING MACHINE

(71) Applicant: KYB Corporation, Tokyo (JP)

(72) Inventors: Gen Takei, Kanagawa (JP); Tetsuya Iwanaji, Kanagawa (JP); Hiroaki Kuboi, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 17/999,488

(22) PCT Filed: Mar. 11, 2021

(86) PCT No.: PCT/JP2021/009845
§ 371 (c)(1),
(2) Date: Nov. 21, 2022

(87) PCT Pub. No.: WO2021/240952
PCT Pub. Date: Dec. 2, 2021

(65) Prior Publication Data

US 2023/0204017 A1 Jun. 29, 2023

(30) Foreign Application Priority Data

May 26, 2020 (JP) ..... 2020-091537

(51) Int. Cl.
*F04B 1/2078* (2020.01)
*F04B 1/32* (2020.01)
*F04B 1/306* (2020.01)

(52) U.S. Cl.
CPC ..... *F04B 1/2078* (2013.01); *F04B 1/306* (2013.01); *F04B 1/32* (2013.01)

(58) Field of Classification Search
CPC ..... F04B 1/2078; F04B 1/306; F04B 1/32; F04B 1/00; F04B 1/005; F04B 1/04; F04B 1/12; F04B 49/00; F04B 49/002
(Continued)

(56) References Cited

U.S. PATENT DOCUMENTS 2,915,985 A * 12/1959 Budzich ..... F04B 49/08 92/57
3,221,660 A * 12/1965 D Amato ..... F04B 1/324 417/222.1

(Continued)

FOREIGN PATENT DOCUMENTS

JP H06-87676 U 12/1994
JP H07-35031 A 2/1995
JP 2020-051380 A 4/2020

*Primary Examiner* — Kenneth J Hansen
*Assistant Examiner* — Benjamin Doyle
(74) *Attorney, Agent, or Firm* — Rabin & Berdo, P.C.

(57) ABSTRACT

A piston pump includes: a tilting mechanism configured to bias a swash plate in accordance with a control pressure; a support spring configured to support the swash plate; and a regulator configured to control a control pressure guided to the tilting mechanism in accordance with a self-pressure of the piston pump. The regulator has an outer spring and an inner spring configured to be extended and compressed by following tilting of the swash plate; and a control spool configured to be moved in accordance with a biasing force from the outer spring and the inner spring, the control spool being configured to regulate the control pressure, and the outer spring and the inner spring and the support spring are provided adjacent to each other and in parallel with respect to the swash plate.

6 Claims, 3 Drawing Sheets

(58) Field of Classification Search
USPC ..... 417/375; 92/12, 13
See application file for complete search history.

(56) References Cited

U.S. PATENT DOCUMENTS 3,426,686 A * 2/1969 Anderson ..... F04B 1/324 417/218
3,738,779 A * 6/1973 Hein ..... F04B 49/08 91/506
3,788,773 A * 1/1974 Van der Kolk ..... F04B 49/002 417/217
3,830,594 A * 8/1974 Hein ..... F04B 49/002 417/217
4,028,010 A * 6/1977 Hopkins ..... F04B 1/324 417/217
4,072,442 A * 2/1978 Horiuchi ..... F04B 49/08 417/218
4,097,196 A * 6/1978 Habiger ..... F04B 49/08 417/222.1
4,212,596 A * 7/1980 Ruseff ..... F04B 49/007 60/486
4,355,510 A * 10/1982 Ruseff ..... F04B 1/08 60/452
4,379,389 A * 4/1983 Liesener ..... F04B 1/324 60/428
4,381,176 A * 4/1983 Kouns ..... F04B 49/02 417/222.1
4,381,647 A * 5/1983 Ruseff ..... F04B 49/002 60/452
5,207,751 A * 5/1993 Suzuki ..... F04B 1/324 60/443
5,251,537 A * 10/1993 Hoshino ..... F04B 1/324 91/506
6,033,188 A * 3/2000 Baldus ..... F04B 49/08 417/222.1
6,102,490 A * 8/2000 Ko ..... B60T 8/4809 303/10
11,603,830 B2 * 3/2023 Akami ..... F04B 1/324
2002/0176784 A1 * 11/2002 Du ..... F04B 1/324 417/213
2020/0340360 A1 10/2020 Iwanaji

* cited by examiner

FLUID PRESSURE ROTATING MACHINE

TECHNICAL FIELD

The present invention relates to a fluid pressure rotating machine.

BACKGROUND ART

JP1995-35031A discloses a variable displacement hydraulic pump that is configured such that a tilted angle of a swash plate can be changed by an operation of a controlling cylinder. In this variable displacement hydraulic pump, the swash plate is biased in the direction in which the tilted angle of the swash plate is increased by a return spring. In this configuration, the tilted angle of the swash plate is changed against a biasing force exerted by the return spring as a control hydraulic pressure is supplied to a control chamber in the controlling cylinder via a capacity control valve that is fixed to an end cover and a control piston is moved along the controlling cylinder.

SUMMARY OF INVENTION

In the hydraulic pump disclosed in JP1995-35031A, the swash plate is biased by the control piston and is supported by the return spring that exerts the biasing force against the biasing force exerted by the control piston. In addition, the control piston is moved in accordance with the control hydraulic pressure that is adjusted by the capacity control valve. As described above, in the above-described hydraulic pump, in order to control a tilting angle of the swash plate, the control piston, the return spring, and the capacity control valve are provided in a housing or on the end cover, and therefore, the configuration of the hydraulic pump tends to have a large size.

An object pf the present invention is to reduce a size of a fluid pressure rotating machine.

According to an aspect of the present invention, a fluid pressure rotating machine is provided with: a cylinder block configured to be rotated together with a driving shaft; a plurality of cylinders formed in the cylinder block, the cylinders being arranged at predetermined intervals in a circumferential direction of the driving shaft; pistons respectively inserted into the cylinders in a slidable manner, the pistons being configured to each define a capacity chamber in an interior of the cylinder; a tiltable swash plate configured to cause the pistons to reciprocate such that the capacity chambers are expanded and contracted; a tilting mechanism configured to bias the swash plate in accordance with control pressure supplied; a support biasing member configured to support the swash plate by exerting a biasing force against the biasing force from the tilting mechanism; and a regulator configured to control the control pressure guided to the tilting mechanism in accordance with self-pressure of the fluid pressure rotating machine. The regulator has: a biasing member configured to be extended and compressed by following tilting of the swash plate; and a control spool configured to be moved in accordance with a biasing force from the biasing member, the control spool being configured to regulate the control pressure. The biasing member and the support biasing member are provided adjacent to each other and in parallel with respect to the swash plate.

DESCRIPTION OF EMBODIMENTS

In the following, a fluid pressure rotating machine 100 according to an embodiment of the present invention will be described with reference to the drawings.

The fluid pressure rotating machine 100 functions as a piston pump capable of supplying working oil serving as working fluid by causing pistons 5 to reciprocate by rotating a shaft (a driving shaft) 1 by an externally supplied motive force. In addition, the fluid pressure rotating machine 100 functions as a piston motor capable of outputting a rotationally driving force by rotating the shaft 1 by causing the pistons 5 to reciprocate by fluid pressure of the externally supplied working oil. In the above, the fluid pressure rotating machine 100 may function only as the piston pump or only as the piston motor.

In the following description, a case in which the fluid pressure rotating machine 100 is used as the piston pump will be illustrated, and the fluid pressure rotating machine 100 is referred to as "a piston pump 100".

Figure 1:
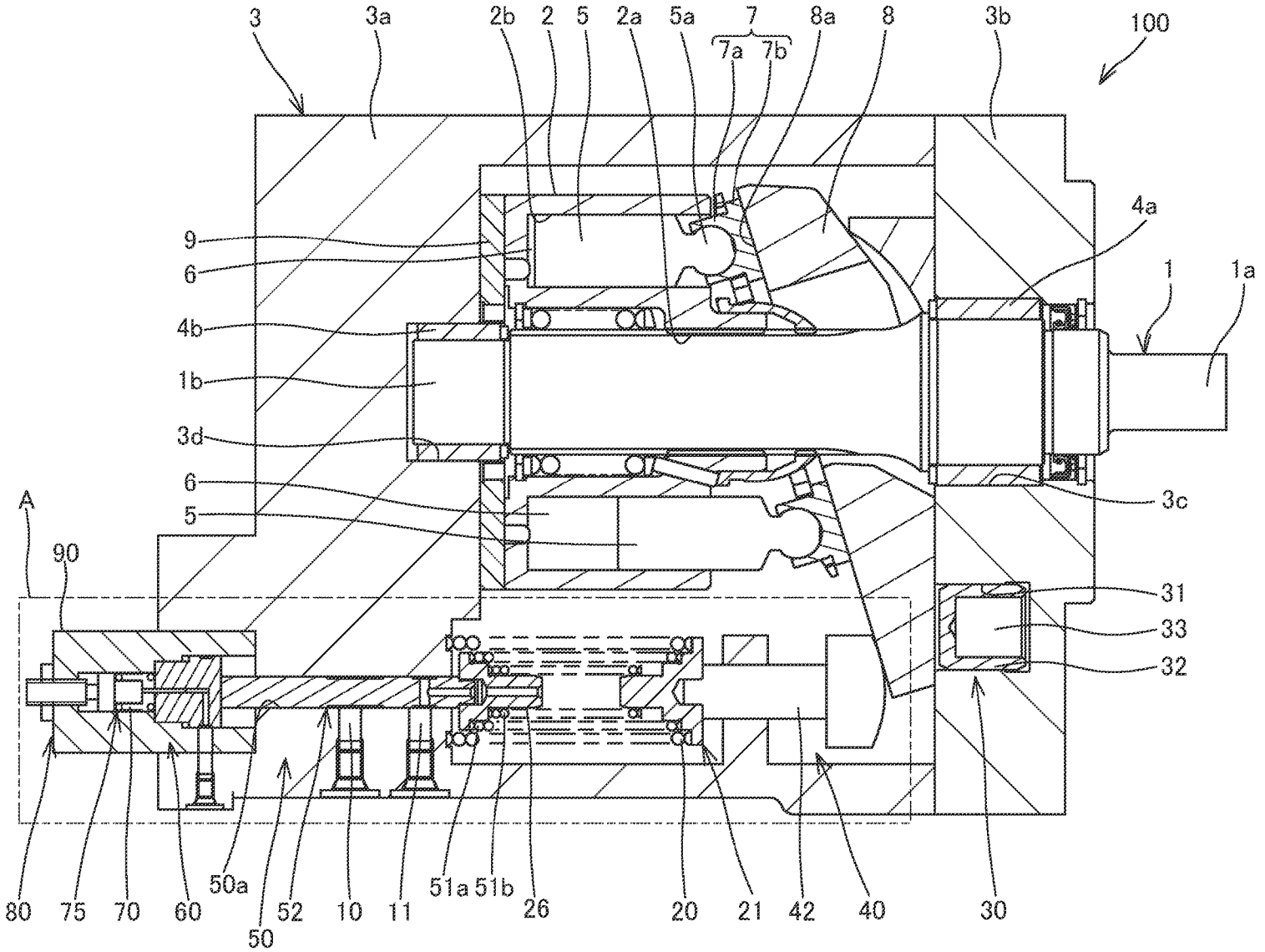
FIG. 1 is a sectional view of a fluid pressure rotating machine according to an embodiment of the present invention.

The piston pump 100 is used as a hydraulic pressure source that supplies the working oil to an actuator (not shown) for driving a driving target, such as a hydraulic cylinder, etc., for example. As shown in FIG. 1, the piston pump 100 is provided with the shaft 1 that is rotated by a motive-power source, a cylinder block 2 that is linked to the shaft 1 and rotated together with the shaft 1, and a case 3 serving as a housing member that accommodates the cylinder block 2.

The case 3 is provided with a bottomed tubular case main body 3*a* and a cover 3*b* that closes an opening end of the case main body 3*a* and through which the shaft 1 is inserted. An interior of the case 3 is communicated with a tank (not shown) through a drain passage (not shown). In the above, the interior the case 3 may be communicated with a suction passage (not shown), which will be described later.

One end portion 1*a* of the shaft 1 that is projected outside via an insertion hole 3*c* of the cover 3*b* is connected to the motive-power source (not shown) such as an engine, etc. The end portion 1*a* of the shaft 1 is rotatably supported by the insertion hole 3*c* of the cover 3*b* via a bearing 4*a*. Other end portion 1*b* of the shaft 1 is accommodated in a shaft accommodating hole 3*d* that is provided in a bottom portion of the case main body 3*a* and is rotatably supported via a bearing 4*b*. Although an illustration is omitted, a rotation shaft (not shown) of another hydraulic pump (not shown), such as a gear pump, etc., which is driven together with the piston pump 100 by the motive-power source, is connected to the other end portion 1*b* of the shaft 1 coaxially so as to be rotated together with the shaft 1.

The cylinder block 2 has a through hole 2*a* through which the shaft 1 is penetrated and the cylinder block 2 is spline-connected to the shaft 1 via the through hole 2*a*. With such a configuration, the cylinder block 2 is rotated together with the rotation of the shaft 1.

In the cylinder block 2, a plurality of cylinders 2*b* each having an opening portion on one end surface are formed so as to extend in parallel with the shaft 1. The plurality of cylinders 2*b* are formed at predetermined intervals in the circumferential direction of the cylinder block 2. In each of the cylinders 2*b*, the columnar piston 5 that defines a capacity chamber 6 is inserted so as to be freely reciprocatable. A tip end side of each piston 5 is projected from the opening portion of the cylinder 2*b*, and a spherical surface seat 5*a* is formed on a tip end portion thereof.

The piston pump 100 is further provided with shoes 7 that are each freely rotatably coupled with the spherical surface seat 5*a* of the piston 5 and in sliding contact with the spherical surface seat 5*a*, a swash plate 8 that is in sliding contact with the shoes 7 along with the rotation of the cylinder block 2, and a valve plate 9 provided between the cylinder block 2 and the bottom portion of the case main body 3*a*.

Each of the shoes 7 is provided with a receiving portion 7*a* that receives the spherical surface seat 5*a* that is formed on the tip end of each piston 5 and a circular flat plate portion 7*b* that is in sliding contact with a sliding contact surface 8*a* of the swash plate 8. An inner surface of the receiving portion 7*a* is formed to have a spherical surface shape and is brought into sliding contact with an outer surface of the received spherical surface seat 5*a*. With such a configuration, the shoe 7 can undergo angular displacement in any directions with respect to the spherical surface seat 5*a*.

In order to make a discharge amount of the piston pump 100 variable, the swash plate 8 is supported by the cover 3*b* so as to be tiltable. The flat plate portions 7*b* of the shoes 7 are in surface contact with the sliding contact surface 8*a*.

The valve plate 9 is a disc shaped member with which a base end surface of the cylinder block 2 is brought into sliding contact and is fixed to the bottom portion of the case main body 3*a*. Although not shown in the figures, the valve plate 9 is formed with a suction port that connects the suction passage formed in the cylinder block 2 with the capacity chambers 6 and a discharge port that connects a discharge passage formed in the cylinder block 2 with the capacity chambers 6.

The piston pump 100 is further provided with a support spring 20 serving as a support biasing member that biases the swash plate 8 in the direction in which the tilting angle is increased, a tilting mechanism 30 that biases the swash plate 8 in the direction in which the tilting angle is decreased in accordance with fluid pressure supplied thereto, and a regulator 50 that controls the fluid pressure to be guided to the tilting mechanism 30 in accordance with the tilting angle of the swash plate 8.

The support spring 20 is a coil spring and supports the swash plate 8 by exerting the biasing force against the biasing force exerted by the tilting mechanism 30.

Figure 2:
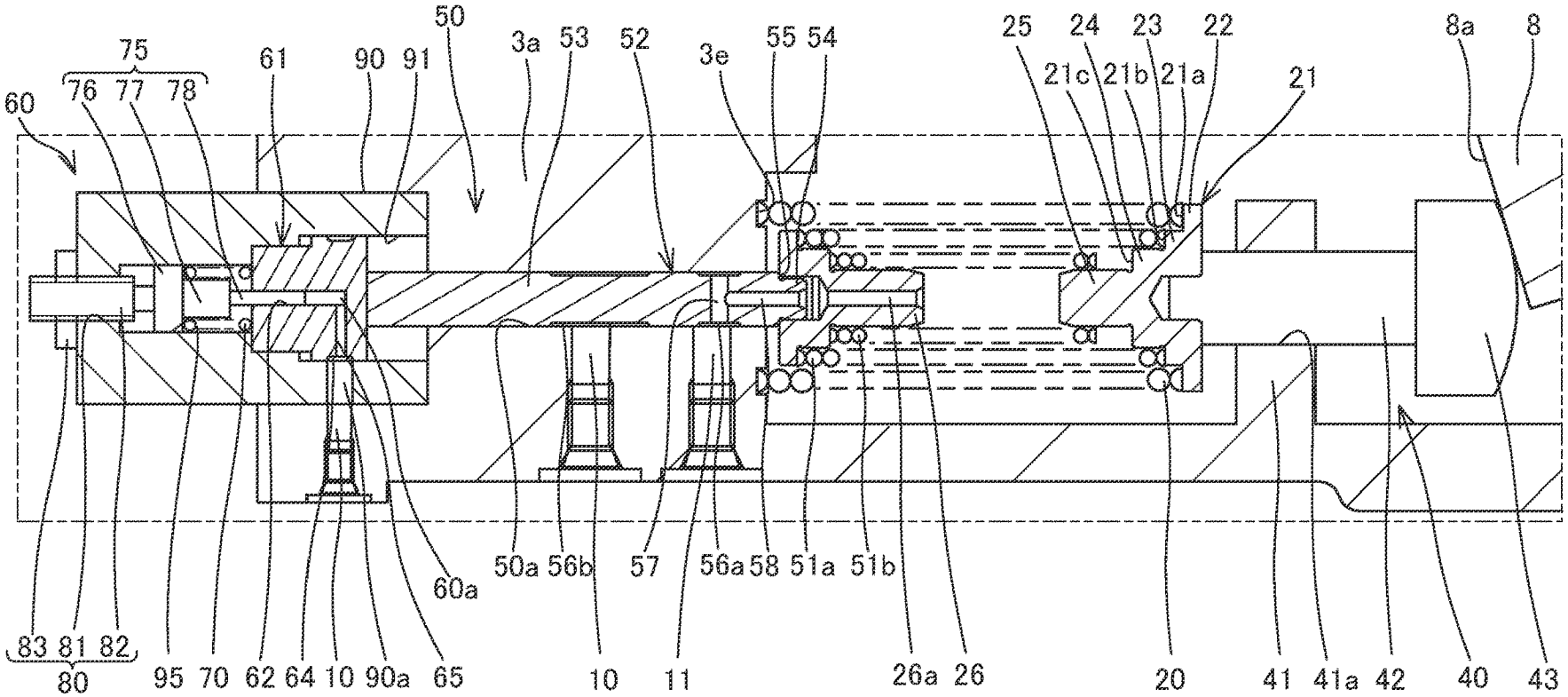
FIG. 2 is an enlarged sectional view of a portion A in FIG. 1.

As shown in FIG. 2, the one end of the support spring 20 is seated on a first spring seat 21 and the other end thereof is seated on a bottom portion of the case main body 3*a*. The support spring 20 is provided between the first spring seat 21 and the case main body 3*a* in a compressed state. The bottom portion of the case main body 3*a* is formed with an annular support groove 3*e* in which the other end portion of the support spring 20 is seated, thereby supporting the other end portion.

The first spring seat 21 is a substantially disc shaped member having a first flange portion 22, a second flange portion 23 having a smaller outer diameter than the first flange portion 22, a third flange portion 24 having a smaller outer diameter than the second flange portion 23, and a boss portion 25 that has a smaller outer diameter than the third flange portion 24 and that projects out from the third flange portion 24 in the axial direction. The support spring 20 is seated on the first spring seat 21 by utilizing a stepped surface 21*a* formed by an outer diameter difference between the first flange portion 22 and the second flange portion 23 as a seating surface. The first spring seat 21 is moved in accordance with the tilting of the swash plate 8 by the biasing force exerted by the support spring 20 and an outer spring 51*a*/an inner spring 51*b*, which will be described later.

As shown in FIG. 1, the tilting mechanism 30 has a large-diameter piston 32 that is slidably inserted into a piston accommodating hole 31 formed in the cover 3*b* and is brought into contact with the swash plate 8 and a control pressure chamber 33 that is defined in the piston accommodating hole 31 by the large-diameter piston 32.

The fluid pressure (hereinafter, referred to as "the control pressure") regulated by the regulator 50 is guided to the control pressure chamber 33. The large-diameter piston 32 biases the swash plate 8 in the direction in which the tilting angle is decreased by the control pressure guided to the control pressure chamber 33.

The piston pump 100 further has a guide mechanism 40 that guides the direction in which the biasing force exerted by the support spring 20 and the outer spring 51*a*/the inner spring 51*b*, which will be described later, is imparted to the swash plate 8. In other words, the guide mechanism 40 guides transmission of the biasing force exerted by the support spring 20, the outer spring 51*a*, and the inner spring 51*b* to the swash plate 8 by guiding the movement of the first spring seat 21. As shown in FIG. 2, the guide mechanism 40 has a guide wall portion 41 that is formed on an inner circumference of the case main body 3*a* and a guide pin 42 that is slidably inserted into a guide hole 41*a* formed in the guide wall portion 41.

The guide hole 41*a* is formed in the guide wall portion 41 such that its center axis extends in parallel with the center axis of the shaft 1 and extends in parallel with (more specifically, in coaxial with) the center axis of a control spool 52, which will be described later. A base end of the guide pin 42 is connected to the first spring seat 21 and a tip end of the guide pin 42 is provided with a contacting portion 43 that is formed to have a substantially spherical surface shape and that is brought into contact with the swash plate 8.

The movement of the first spring seat 21 is guided by the guide mechanism 40 along the center axial direction of the guide hole 41*a*. With such a configuration, the biasing force exerted by the support spring 20 (and the outer spring 51*a* and the inner spring 51*b*, which will be described later) is applied to the swash plate 8 via the first spring seat 21 and the guide mechanism 40 along the axial direction of the guide hole 41*a*. In other words, the guide pin 42 of the guide mechanism 40 and the first spring seat 21 are moved so as to follow the tilting of the swash plate 8, and thereby, the support spring 20 (and the outer spring 51*a* and the inner spring 51*b*, which will be described later) is extended and compressed. As described above, the guide pin 42 also functions as a feedback pin that transmits the tilting of the swash plate 8 to the regulator 50.

As shown in FIG. 1, the large-diameter piston 32 is provided on the opposite side from the guide pin 42 of the guide mechanism 40. In other words, the large-diameter piston 32 is arranged such that the position thereof in the circumferential direction with respect to the center axis of the shaft 1 substantially coincides with that of the guide pin 42.

The regulator 50 controls horsepower (output) of the piston pump 100 by regulating the control pressure to be guided to the control pressure chamber 33 in accordance with the discharge pressure of the piston pump 100.

The regulator 50 has the outer spring 51*a* and the inner spring 51*b* each serving as a biasing member that biases the swash plate 8 via the first spring seat 21, the control spool 52 that regulates the control pressure by being moved in accordance with the biasing force exerted by the outer spring 51*a* and the inner spring 51*b*, and a pressing mechanism 60 that presses the control spool 52 against the biasing force exerted by the outer spring 51*a* and the inner spring 51*b*.

The outer spring 51*a* and the inner spring 51*b* are each a coil spring and are extended and compressed so as to follow the tilting of the swash plate 8. The inner spring 51*b* has the coiling diameter smaller than that of the outer spring 51*a* and is provided on the inner side of the outer spring 51*a*. In addition, the outer spring 51*a* has the coiling diameter smaller than that of the support spring 20 and is provided on the inner side of the support spring 20. In other words, the outer spring 51*a* and the inner spring 51*b* are both provided on the inner side of the support spring 20.

The one end portion of each of the outer spring 51*a* and the inner spring 51*b* is seated on the first spring seat 21. Specifically, as shown in FIG. 2, the outer spring 51*a* is seated on the first spring seat 21 by utilizing a stepped surface 21*b* formed by an outer diameter difference between the second flange portion 23 and the third flange portion 24 of the first spring seat 21 as the seating surface. The inner spring 51*b* can be seated on the first spring seat 21 by utilizing a stepped surface 21*c* formed by an outer diameter difference between the third flange portion 24 and the boss portion 25 of the first spring seat 21 as the seating surface. The boss portion 25 is inserted into the inner side of the inner spring 51*b* so as to support an inner circumference of the inner spring 51*b*.

The other end portion of each of the outer spring 51*a* and the inner spring 51*b* is seated on an end surface of the control spool 52 via a second spring seat 26. The second spring seat 26 is moved together with the control spool 52.

The second spring seat 26 is formed to have the outer diameter that is smaller than the inner diameter of the support spring 20 and is provided on the inner side of the support spring 20. The other end portion of the support spring 20 is not seated on the second spring seat 26, but is seated in the support groove 3*e* of the bottom portion of the case main body 3*a* as described above. Thus, the one end portion of the support spring 20 that is seated on the first spring seat 21 is moved so as to follow the tilting of the swash plate 8, and the other end portion of the support spring 20 that is seated in the support groove 3*e* is not moved so as to follow the tilting of the swash plate 8. In other words, the other end portion of the support spring 20 is configured such that the movement is not caused due to the tilting of the swash plate 8.

In a state in which the tilting angle of the swash plate 8 is maximized (the state shown in FIG. 1), the second spring seat 26 is in a floating state in which the second spring seat 26 is not in contact with the bottom portion of the case main body 3*a* and is separated away from the bottom portion.

The natural length (the free length) of the outer spring 51*a* is longer than the natural length of the inner spring 51*b*. In a state in which the tilting angle of the swash plate 8 is maximized (the state shown in FIG. 1), while the outer spring 51*a* is in the compressed state between the first spring seat 21 and the second spring seat 26, the inner spring 51*b* is in a state in which either of the end portions thereof (the first spring seat 21 in FIG. 1) is separated away from the spring seat and the inner spring 51*b* is in the floated state (the state in which the inner spring 51*b* has the natural length). In other words, when the tilting angle of the swash plate 8 is decreased from the maximum state, only the outer spring 51*a* is compressed at the beginning. Once the outer spring 51*a* is compressed to the point at which the length of the outer spring 51*a* becomes shorter than the natural length of the inner spring 51*b*, both of the outer spring 51*a* and the inner spring 51*b* are compressed. Thus, a configuration in which an elastic force exerted by the outer spring 51*a* and the inner spring 51*b* and applied to the swash plate 8 via the guide pin 42 is increased stepwise is achieved.

As described above, the support spring 20 serving as the support biasing member and the outer spring 51*a* and the inner spring 51*b* each serving as the biasing member are provided adjacent to each other and in parallel with respect to the swash plate 8. More specifically, the outer spring 51*a* and the inner spring 51*b* are provided on the inner side in the radial direction of the support spring 20. Furthermore, a configuration in which the biasing force exerted by the support spring 20 and the biasing force exerted by the outer spring 51*a* and the inner spring 51*b* are imparted in parallel with respect to the swash plate 8 is achieved. Therefore, compared with a case in which a space for providing the support spring 20 and spaces for providing the outer spring 51*a* and the inner spring 51*b* are provided separately and independently, at least a part of an installation space can be shared, and therefore, it is possible to achieve space saving.

As shown in FIG. 2, in the case main body 3*a*, a spool accommodating hole 50*a* into which the control spool 52 is slidably inserted is formed.

In addition, in the case main body 3*a*, a discharge pressure passage 10 to which the discharge pressure of the piston pump 100 is guided and a control pressure passage 11 that guides the control pressure to the control pressure chamber 33 of the large-diameter piston 32 are formed. The discharge pressure from the piston pump 100 is always guided to the discharge pressure passage 10. The control pressure passage 11 communicates with the control pressure chamber 33 through a cover-side passage (not shown) formed in the cover 3*b*.

The spool accommodating hole 50*a* communicates with the interior of the case main body 3*a* and opens at an end surface of the case main body 3*a*. An opening of the spool accommodating hole 50*a* formed at the end surface of the case main body 3*a* is closed by a cap 90.

The control spool 52 has a main body portion 53 that is in sliding contact with an inner circumferential surface of the spool accommodating hole 50*a* and a projected portion 54 that is inserted into the second spring seat 26.

The projected portion 54 is formed so as to have a smaller outer diameter than the main body portion 53, and a stepped surface 55 that is formed by an outer diameter difference between the main body portion 53 and the projected portion 54 is brought into contact with the second spring seat 26.

A first control port 56*a* and a second control port 56*b* are each formed as an annular groove in an outer circumference of the control spool 52. In addition, in the control spool 52, a first control passage 57 that communicates with the first control port 56*a* is formed so as to penetrate through the control spool 52 in the radial direction. Furthermore, the control spool 52 is formed with an axial direction passage 58 that is provided so as to extend in the axial direction from the one end portion (the projected portion 54). Through the axial direction passage 58, the first control passage 57 is communicated with a connection passage 26*a* formed in the second spring seat 26 and opens to the interior of the case main body 3*a*.

As described above, the first control passage 57 communicates with the interior of the case 3 via the axial direction passage 58 and the connection passage 26*a* of the second spring seat 26. Thus, the pressure in the first control passage 57 is equalized to tank pressure.

The pressing mechanism 60 has an auxiliary spring 70 serving as an auxiliary biasing member that exerts the biasing force to the control spool 52 against the biasing force exerted to the control spool 52 by the outer spring 51*a* and the inner spring 51*b*, an adjusting mechanism 80 that adjusts the biasing force exerted by the auxiliary spring 70, and a pressing piston 61 serving as a pressing member that is accommodated in an accommodating hole 91 formed in the cap 90 and is brought into contact with the end surface of the control spool 52.

The auxiliary spring 70 is a coil spring. The auxiliary spring 70 is accommodated in a concave portion 95 formed in the cap 90. The one end of the auxiliary spring 70 is seated on a seat member 75 that is accommodated in the concave portion 95 in the cap 90, and the other end of the auxiliary spring 70 is seated on an end surface of the pressing piston 61. The auxiliary spring 70 is provided between the seat member 75 and the pressing piston 61 in the compressed state and exerts the biasing force to the control spool 52 via the pressing piston 61.

The seat member 75 has a plate shaped base portion 76 that is in sliding contact with an inner circumferential surface of the concave portion 95 in the cap 90, a support portion 77 that projects out in the axial direction from the base portion 76 and that supports an inner circumference of the auxiliary spring 70, and an axial portion 78 that projects out in the axial direction from a tip end of the support portion 77. One end portion of the auxiliary spring 70 is seated on an end surface of the base portion 76 to which the support portion 77 is connected.

The adjusting mechanism 80 has: an internal thread hole 81 that is formed in the cap 90; a screw member 82 that is threaded to the internal thread hole 81 and moves the seat member 75 back and forth in the biasing direction by the auxiliary spring 70; and a nut 83 that fixes a threaded position of the screw member 82 with respect to the internal thread hole 81.

The internal thread hole 81 is formed so as to penetrate through a bottom portion of the concave portion 95 and opens to the concave portion 95.

The screw member 82 is brought into contact with the base portion 76 on the other side in the axial direction from the end surface on which the auxiliary spring 70 is seated. By adjusting the threaded position between the screw member 82 and the internal thread hole 81, the screw member 82 is moved back and forth with respect to the seat member 75 in the axial direction (the direction of the biasing force exerted by the auxiliary spring 70). By moving the screw member 82 back and forth, the seat member 75 is moved back and forth such that the auxiliary spring 70 is extended and compressed, and thereby, it is possible to adjust a set load (initial load) of the auxiliary spring 70. With such a configuration, the regulator 50 is configured such that the biasing force exerted by the auxiliary spring 70 can be adjusted. As the nut 83 is threaded to the screw member 82 and tightened against the cap 90, the threaded position of the screw member 82 with respect to the internal thread hole 81 is fixed.

The accommodating hole 91 of the cap 90 is provided so as to be coaxial with the spool accommodating hole 50*a* formed in the case main body 3*a*. In addition, the accommodating hole 91 of the cap 90 is formed to be continuous with the concave portion 95 and to be coaxial with the concave portion 95, thereby facing the spool accommodating hole 50*a*. The one end portion of the control spool 52 is also accommodated in the accommodating hole 91 of the cap 90.

The pressing piston 61 is pressed against a stepped surface between the accommodating hole 91 and the concave portion 95 by the biasing force exerted by the outer spring 51*a* and transmitted via the control spool 52. With such a configuration, the movement of the control spool 52 in the left direction in the figure by the biasing force exerted by the outer spring 51*a* beyond a predetermined range is restricted by the pressing piston 61.

In addition, the pressing piston 61 is formed with an axial-portion insertion hole 62 into which the axial portion 78 of the seat member 75 is inserted. By inserting the axial portion 78 into the axial-portion insertion hole 62 in the pressing piston 61, a signal-pressure chamber 60*a* to which signal pressure used for the horsepower control is guided is formed in the pressing piston 61 with the axial portion 78 and an inner wall of the axial-portion insertion hole 62.

The signal-pressure chamber 60*a* communicates with the discharge pressure passage 10 via a communication port 64 that is formed in an outer circumference of the pressing piston 61, a signal-pressure passage 65 that connects the signal-pressure chamber 60*a* and the communication port 64, and a cap passage 90*a* formed in the cap 90. Thus, the discharge pressure (self-pressure) of the piston pump 100 is guided to the signal-pressure chamber 60*a* as the signal pressure.

The signal pressure guided to the signal-pressure chamber 60*a* is applied to an inner wall portion the signal-pressure chamber 60*a* facing the axial portion 78. Thus, the control spool 52 receives the signal pressure via the pressing piston 61 with a pressure receiving area corresponding to the cross-sectional area of the axial portion 78 (in other words, the cross-sectional area of the axial-portion insertion hole 62), and thereby, the control spool 52 is biased by the signal pressure in the direction in which the outer spring 51*a* and the inner spring 51*b* are compressed. As described above, the pressing piston 61 receives a thrust force generated by the signal pressure that has been guided to the signal-pressure chamber 60*a* and presses the control spool 52 so as to move it against the biasing force exerted by the outer spring 51*a* and the inner spring 51*b*.

As described above, the control spool 52 is biased by the biasing force exerted by the outer spring 51*a* and the inner spring 51*b* in the direction moving away from the swash plate 8 (the left direction in the figure). The control spool 52 is biased via the pressing piston 61 in the direction approaching the swash plate 8 by the discharge pressure of the piston pump 100 guided to the signal-pressure chamber 60*a* and the biasing force exerted by the auxiliary spring 70. In other words, the control spool 52 is moved such that the biasing force exerted by the outer spring 51*a* and the inner spring 51*b*, the biasing force exerted by the auxiliary spring 70, and the biasing force generated by the discharge pressure of the piston pump 100 are balanced. As described above, by causing the biasing force exerted by the auxiliary spring 70 and the thrust force generated by the signal pressure of the signal-pressure chamber 60*a* to be imparted to the control spool 52, it is possible to regulate properties of the horsepower control by the regulator 50.

More specifically, for the movement of the control spool 52, the control spool 52 is moved between two positions, i.e. between a first position and a second position. FIGS. 1 and 2 each shows a state in which the control spool 52 is positioned at the second position (the same applies to FIG. 3, which will be described later). The position of the control spool 52 is switched from the second position shown in FIGS. 1 and 2 to the first position as the control spool 52 is moved to the right direction in the figure.

The first position is a position at which the tilting angle of the swash plate 8 is decreased to reduce the discharge capacity of the piston pump 100. When the control spool 52 is positioned at the first position, the discharge pressure passage 10 in the case main body 3*a* is communicated with the control pressure passage 11 via the second control port 56*b* of the control spool 52, and the communication between the first control passage 57 of the control spool 52 and the control pressure passage 11 is shut off. Thus, when the control spool 52 is positioned at the first position, the discharge pressure from the piston pump 100 is guided to the control pressure chamber 33 of the tilting mechanism 30.

The second position is a position at which the tilting angle of the swash plate 8 is increased to increase the discharge capacity of the piston pump 100. When the control spool 52 is positioned at the second position, the control pressure passage 11 is communicated with the first control passage 57 of the control spool 52 via the first control port 56*a*, and the communication between the discharge pressure passage 10 and the control pressure passage 11 is shut off. Thus, when the control spool 52 is positioned at the second position, the tank pressure is guided to the control pressure chamber 33.

Next, the effects of the piston pump 100 will be described.

In the piston pump 100, the horsepower control is performed such that the discharge capacity of the piston pump 100 (the tilting angle of the swash plate 8) is controlled by the regulator 50 so as to maintain the discharge pressure from the piston pump 100 constant.

The control spool 52 of the regulator 50 is biased by the biasing force generated by the signal pressure in the signal-pressure chamber 60*a* (the discharge pressure of the piston pump 100) and the biasing force exerted by the auxiliary spring 70 so as to be positioned at the first position, and the control spool 52 is biased by the biasing force exerted by the outer spring 51*a* and the inner spring 51*b* so as to be positioned at the second position.

In a state in which the biasing force generated by the signal pressure in the signal-pressure chamber 60*a* and the biasing force exerted by the auxiliary spring 70 are maintained so as to be equal to or lower than the biasing force exerted by the outer spring 51*a*, the control spool 52 of the regulator 50 is positioned at the second position, and the tilting angle of the swash plate 8 is maintained at the maximum angle (see FIG. 1).

The discharge pressure from the piston pump 100 is increased as a load of a hydraulic cylinder driven by the discharge pressure from the piston pump 100 is increased. As the discharge pressure from the piston pump 100 is increased in the state in which the tilting angle of the swash plate 8 is maintained at the maximum angle, the resultant force of the biasing force generated by the signal pressure in the signal-pressure chamber 60*a* and the biasing force exerted by the auxiliary spring 70 comes to exceed the biasing force exerted by the outer spring 51*a*. Thereby, the control spool 52 is moved in the direction (the right direction in the figure) in which the position of the control spool 52 is switched from the second position to the first position.

When the control spool 52 is moved to the first position, the discharge pressure is guided to the control pressure passage 11 from the discharge pressure passage 10, and therefore, the control pressure is increased. More specifically, as the control spool 52 is being moved toward the first position, an opening area (flow passage area) of the second control port 56*b* of the control spool 52 to the control pressure passage 11 is increased. Thus, as a moved amount of the control spool 52 in the direction in which the position of the control spool 52 is switched to the first position (the right direction in the figure) is increased, the control pressure guided to the control pressure passage 11 is increased. As the control pressure guided to the control pressure passage 11 is increased, the large-diameter piston 32 (see FIG. 1) is moved toward the swash plate 8 against the biasing force exerted by the support spring 20, and the swash plate 8 is tilted in the direction in which the tilting angle is decreased. Thus, the discharge capacity of the piston pump 100 is reduced.

As the swash plate 8 is tilted in the direction in which the tilting angle is decreased, the guide pin 42 is moved in the left direction in the figure by following the swash plate 8 so as to compress the support spring 20, the outer spring 51*a*, and the inner spring 51*b*. In other words, as the swash plate 8 is tilted in the direction in which the tilting angle is decreased, the guide pin 42 is moved so as to bias the control spool 52 via the outer spring 51*a* (and the inner spring 51*b*) in the direction in which the position of the control spool 52 is switched to the second position. Thereby, as the control spool 52 is pushed buck and moved in the direction in which the position of the control spool 52 is switched to the second position, the control pressure supplied to the control pressure chamber 33 through the control pressure passage 11 is decreased. As the control pressure is decreased, when the biasing force imparted to the swash plate 8 by the control pressure is balanced with the resultant force of the biasing force imparted to the swash plate 8 by the support spring 20 and the outer spring 51*a* (and the inner spring 51*b*), the movement of the large-diameter piston 32 (the tilting of the swash plate 8) is stopped. As described above, as the discharge pressure from the piston pump 100 is increased, the discharge capacity is reduced.

Conversely, the discharge pressure from the piston pump 100 is decreased as the load of the hydraulic cylinder driven by the discharge pressure from the piston pump 100 is decreased. As the discharge pressure from the piston pump 100 is decreased, the resultant force of the biasing force generated by the signal pressure in the signal-pressure chamber 60*a* and the biasing force exerted by the auxiliary spring 70 comes to fall below the biasing force exerted by the outer spring 51*a* and the inner spring 51*b*. Thereby, the control spool 52 is moved in the direction in which the position of the control spool 52 is switched from the first position to the second position. When the control spool 52 is moved to the second position, because the control pressure passage 11 is communicated with the first control passage 57 under the tank pressure, the control pressure is decreased. As the control pressure is decreased, the swash plate 8 is tilted in the direction in which the tilting angle is increased by the biasing force exerted by the support spring 20, the outer spring 51*a*, and the inner spring 51*b*.

As the swash plate 8 is tilted in the direction in which the tilting angle is increased, the guide pin 42 receiving the biasing force exerted by the outer spring 51*a* and the inner spring 51*b* is moved in the right direction in the figure by following the swash plate 8 such that the outer spring 51*a* and the inner spring 51*b* are extended. Thereby, the biasing force received by the control spool 52 from the outer spring 51*a* and the inner spring 51*b* is decreased. Therefore, the control spool 52 is moved in the direction in which the outer spring 51*a* and the inner spring 51*b* are compressed by receiving the signal pressure in the signal-pressure chamber 60*a*. In other words, the control spool 52 is moved in the direction in which the position of the control spool 52 is switched from the second position to the first position so as to follow the guide pin 42. When the control spool 52 is positioned at the first position again and the control pressure is increased, and the biasing force imparted to the swash plate 8 by the control pressure is balanced with the biasing force imparted to the swash plate 8 by the support spring 20 and the outer spring 51*a* (and the inner spring 51*b*), then the movement of the large-diameter piston 32 (the tilting of the swash plate 8) is stopped. As described above, as the discharge pressure from the piston pump 100 is decreased, the discharge capacity is increased.

As described above, the horsepower control is performed such that the discharge capacity of the piston pump 100 is reduced as the discharge pressure from the piston pump 100 is increased, and such that the discharge capacity is increased as the discharge pressure is decreased.

According to the embodiment mentioned above, the advantages described below are afforded.

In the piston pump 100, the support spring 20 is provided adjacent to the outer spring 51*a* and the inner spring 51*b* of the regulator 50 so as to be provided in parallel with respect to the swash plate 8. Specifically, the outer spring 51*a* and the inner spring 51*b* are provided on the inner side of the support spring 20. Thus, the space for providing the support spring 20 and the spaces for providing the outer spring 51*a* and the inner spring 51*b* need not be provided independently, and therefore, it is possible to achieve the space saving. Therefore, it is possible to reduce a size of the piston pump 100.

In addition, because there is no need to independently provide the space for providing the support spring 20, it is possible to reduce processing to be performed on the case 3 for forming the space for providing the support spring 20. Thus, it is possible to reduce a production cost of the piston pump 100.

In addition, the piston pump 100 is configured such that, while the one end of the support spring 20 is moved in response to the tilting of the swash plate 8, the other end of the support spring 20 is not moved even if the swash plate 8 is tilted. Because the other end is not moved in response to the tilting of the swash plate 8 as described above, it is possible to stabilize a behavior (motion) of the extension and compression of the support spring 20 associated with the tilting of the swash plate 8, and so, it is possible to allow the biasing force exerted by the support spring 20 to be exhibited stably.

In addition, the biasing force exerted by the support spring 20, the outer spring 51*a*, and the inner spring 51*b* is imparted to the swash plate 8 by being guided by the guide mechanism 40 in the direction along the center axis of the control spool 52. With such a configuration, it is possible to set the direction of the biasing force exerted by the outer spring 51*a* and the inner spring 51*b* acting on the control spool 52 to the direction along the center axis of the control spool 52, and it is possible to suppress inhibition of the movement of the control spool 52 by the biasing force. Thus, sliding friction caused on the control spool 52 is reduced, and it is possible to suppress abrasion of the control spool 52. In addition, because the sliding friction of the control spool 52 is reduced, it is possible to improve hysteresis of the regulator 50.

Next, modifications of this embodiment will be described. The following modifications also fall within the scope of the present invention, and it is also possible to combine the configurations shown in the modifications with the configurations described in the above embodiment, or to combine the configurations described in the following different modifications.

A modification shown in FIG. 3 will be described first. In the modification shown in FIG. 3, configurations that are similar to those in the above-mentioned embodiment are assigned the same reference signs, and descriptions thereof shall be omitted appropriately.

In the above-mentioned embodiment, the control spool 52 is accommodated in the spool accommodating hole 50*a* formed in the case main body 3*a*.

Figure 3:
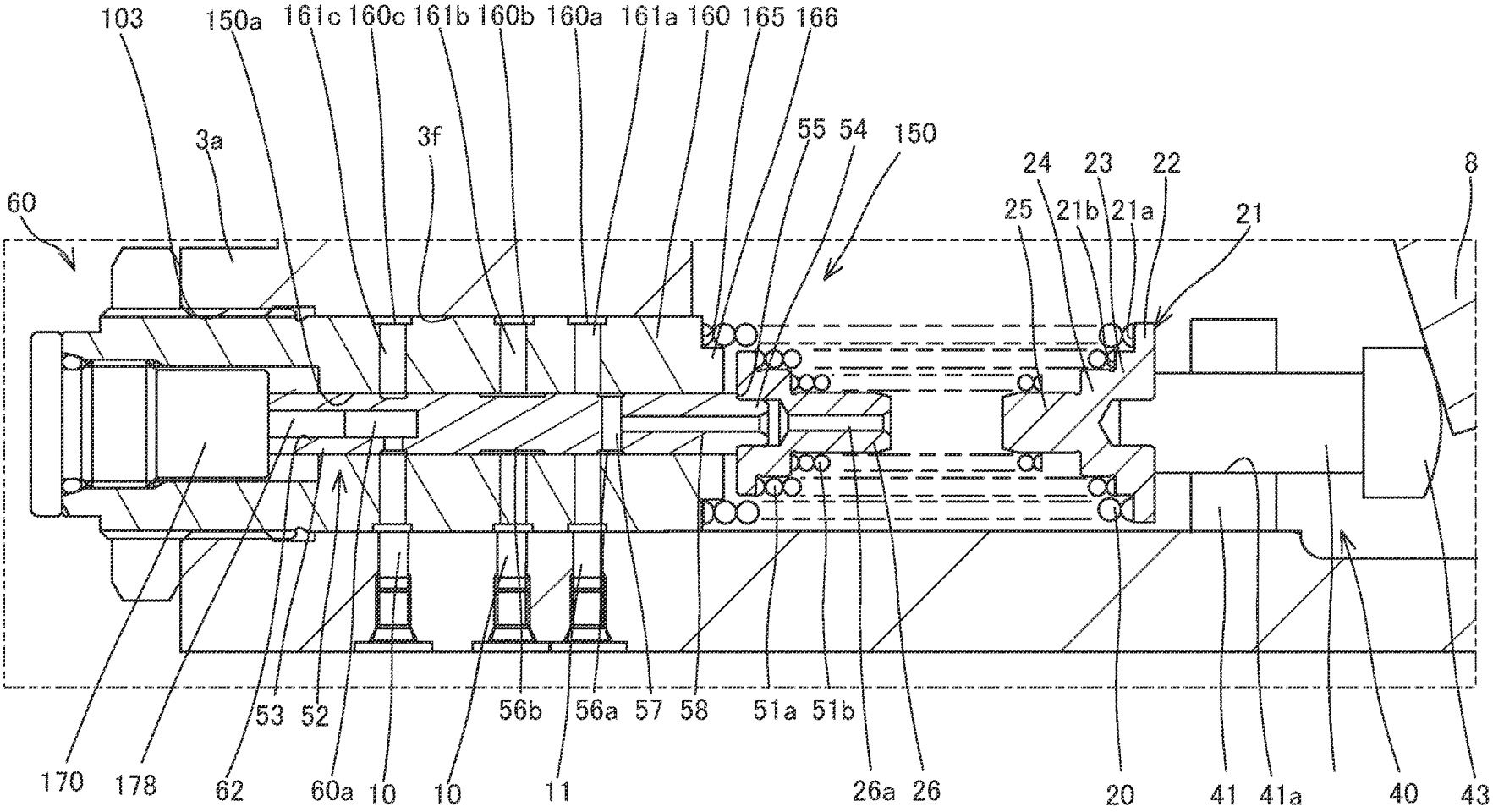
FIG. 3 is a sectional view showing the fluid pressure rotating machine according to a modification of the embodiment of the present invention and is a diagram corresponding to FIG. 2.

In contrast, in the modification shown in FIG. 3, a sleeve 160 is attached to an attachment hole 3*f* formed in the case main body 3*a*, and the control spool 52 is accommodated in a spool accommodating hole 150*a* formed in the sleeve 160. Although the pressing mechanism 60 does not have the auxiliary spring 70 and the adjusting mechanism 80 in this modification, similarly to the above-mentioned embodiment, the auxiliary spring 70 and the adjusting mechanism 80 may also be provided. In the following, the modification shown in FIG. 3 will be described specifically.

In the modification shown in FIG. 3, a regulator 150 has the sleeve 160 that is attached to the attachment hole 3*f* formed in the case main body 3*a*.

The sleeve 160 is attached to the case main body 3*a* by being inserted into the attachment hole 3*f* in the case main body 3*a* so as to be in sliding contact therewith and by being threaded to an internal thread 103 formed in the attachment hole 3*f*. The sleeve 160 is formed with: the spool accommodating hole 150*a* into which the control spool 52 is inserted; a first communication hole 161*a* that communicates with the control pressure passage 11 through a first port 160*a* formed on an outer circumference of the sleeve 160; and a second communication hole 161*b* that communicates with the discharge pressure passage 10 via a second port 160*b* formed on the outer circumference of the sleeve 160. The first port 160*a* and the second port 160*b* are each an annular groove formed in the outer circumferential surface of the sleeve 160. The first communication hole 161*a* and the second communication hole 161*b* respectively intersect the spool accommodating hole 150*a* and communicate with the spool accommodating hole 150*a*.

The one end of the spool accommodating hole 150*a* formed in the sleeve 160 opens to an interior of the case main body 3*a*. The other end of the spool accommodating hole 150*a* is closed by a plug 170 that is attached by being threaded to the sleeve 160.

An axial portion 178 is provided on the plug 170. In addition, the axial-portion insertion hole 62, into which the axial portion 178 of the plug 170 is inserted, is formed in the end portion of the control spool 52 facing the plug 170. The signal-pressure chamber 60*a* is formed by the axial portion 178 of the plug 170 and the inner wall of the axial-portion insertion hole 62 for the control spool 52.

In addition, the sleeve 160 is formed with a seat portion 165 on which the end portion of the support spring 20 is seated and a protruded portion 166 that protrudes from the seat portion 165 to support an inner circumference of the support spring 20. The protruded portion 166 is formed to be smaller than the inner diameter of the support spring 20 and is inserted to the inner side of the support spring 20. The seat portion 165 is an annular plane and is a stepped surface formed by the protruded portion 166. In addition, the outer circumference of the support spring 20 is supported by an inner circumferential surface of the case main body 3*a*.

Thus, the sleeve 160 only needs to support the inner circumference of the support spring 20 with the protruded portion 166.

Even with such a modification, similarly to the above-mentioned embodiment, the one end portion of the support spring 20 is seated on the first spring seat 21 and is moved so as to follow the tilting of the swash plate 8. Because the sleeve 160 is fixed to the case main body 3*a* by being screw-fastened, the other end portion of the support spring 20 that is seated on the sleeve 160 is not moved by the tilting of the swash plate 8. Therefore, even with the modification shown in FIG. 3, the effects and the advantages similar to those of the above-mentioned embodiment are afforded.

In addition, in this modification, the protruded portion 166 for supporting the other end portion of the support spring 20 is formed on the sleeve 160. Compared with the above-mentioned embodiment in which the support groove 3*e* for supporting the other end portion of the support spring 20 is formed in the bottom portion of the case main body 3*a*, it is possible to perform the processing more easily in this modification in which the protruded portion 166 is provided on the sleeve 160. The configuration is not limited thereto, and similarly to the above-mentioned embodiment, in this modification, the other end portion of the support spring 20 may be configured so as to be seated in the support groove 3*e* of the bottom portion of the case main body 3*a*.

Next, another modification will be described.

In the above-mentioned embodiment, the piston pump 100 has the guide mechanism 40 that guides the biasing force exerted by the support spring 20, the outer spring 51*a*, and the inner spring 51*b* (in other words, the movement of the first spring seat 21). In order to achieve the stabilization of the direction of the biasing force imparted to the swash plate 8 from the support spring 20 and to achieve the suppression of the abrasion of the control spool 52, it is preferable that the guide mechanism 40 be provided; however, the guide mechanism 40 is not an essential configuration. For example, the contacting portion having the spherical surface shape coming into contact with the swash plate 8 may be provided on the first spring seat 21 such that the first spring seat 21 is brought into direct contact with the swash plate 8.

In addition, in the above-mentioned embodiment, the positions of the support spring 20 and the tilting mechanism 30 in the radial direction with respect to the swash plate 8 are matched. In other words, the support spring 20 and the tilting mechanism 30 are opposed to each other such that the swash plate 8 is sandwiched therebetween. However, in the piston pump 100, this configuration is not essential. For example, similarly to the support spring 20, the tilting mechanism 30 may be provided on the sliding contact surface 8*a* side of the swash plate 8 (the left side from the swash plate 8 in FIG. 1) so as to be arranged at the position that is separated away from the support spring 20 at an angular interval of 180 degrees. In other words, the support spring 20 and the tilting mechanism 30 may be configured arbitrary as long as they are configured such that the biasing force is applied such that the swash plate 8 is tilted in the opposite directions.

In addition, in the above-mentioned embodiment, the outer spring 51*a* and the inner spring 51*b* are provided on the inner side of the support spring 20 (on the inner side of the support spring 20 in the radial direction and within a range in which the support spring 20 is present in the axial direction). In contrast, the positional relationship between the support spring 20 and the outer spring 51*a*/the inner spring 51*b* is not limited to the configuration in the above-mentioned embodiment as long as they are provided adjacent with each other and in parallel with respect to the swash plate 8. For example, the support spring 20 may be provided between the outer spring 51*a* and the inner spring 51*b* in the radial direction (on the inner side of the outer spring 51*a* and on the outer side of the inner spring 51*b*), or the support spring 20 may be provided on the inner side of the inner spring 51*b*. In addition, the support spring 20 and the outer spring 51*a* (and the inner spring 51*b*) may be provided on the outer side from each other (the first one may be provided on the outer side of the second one, and the second one may be provided on the outer side of the first one). In either case, because the space for providing the space for providing the support spring 20 and the spaces for providing the outer spring 51*a* and the inner spring 51*b* need not be provided separately and independently, it is possible to achieve the space saving and to reduce the size of the piston pump 100.

The configurations, operations, and effects of the embodiments of the present invention will be collectively described below.

The piston pump 100 includes: the cylinder block 2 configured to be rotated together with the shaft 1; the plurality of cylinders 2*b* formed in the cylinder block 2, the cylinders 2*b* being arranged at predetermined intervals in the circumferential direction of the shaft 1; the pistons 5 respectively inserted into the cylinders 2*b* in a slidable manner, the pistons 5 being configured to each define the capacity chamber 6 in the interior of the cylinder 2*b*; the tiltable swash plate 8 configured to cause the pistons 5 to reciprocate such that the capacity chambers 6 are expanded and contracted; the tilting mechanism 30 configured to bias the swash plate 8 in accordance with the control pressure supplied; the support spring 20 configured to support the swash plate 8 by exerting the biasing force against the biasing force from the tilting mechanism 30; and the regulator 50 configured to control the control pressure guided to the tilting mechanism 30 in accordance with the self-pressure of the piston pump 100, wherein the regulator 50 has: the outer spring 51*a* and the inner spring 51*b* configured to be extended and compressed by following the tilting of the swash plate 8; and the control spool 52 configured to be moved in accordance with the biasing force from by the outer spring 51*a* and the inner spring 51*b*, the control spool 52 being configured to regulate the control pressure, and wherein the outer spring 51*a* and the inner spring 51*b* and the support spring 20 are provided adjacent to each other and in parallel with respect to the swash plate 8.

In addition, in the piston pump 100, the support spring 20, the outer spring 51*a*, and the inner spring 51*b* are each the coil spring, and the outer spring 51*a* and the inner spring 51*b* are provided on the inner side of the support spring 20.

With these configurations, because the outer spring 51*a* and the inner spring 51*b* and the support spring 20 are provided adjacent to each other and in parallel with each other, the spaces for accommodating the outer spring 51*a* and the inner spring 51*b* and the space for accommodating the support spring 20 need not be provided independently, and so, it is possible to achieve the space saving. Therefore, it is possible to reduce the size of the piston pump 100.

In addition, the piston pump further includes the guide mechanism 40 configured to guide the biasing force imparted to the swash plate 8 from the support spring 20, the outer spring 51*a*, and the inner spring 51*b*, wherein the guide mechanism 40 has: the guide pin 42 configured to transmit the biasing force from the support spring 20, the outer spring 51*a*, and the inner spring 51*b* to the swash plate 8; and the guide hole 41*a* formed such that the center axis of the guide hole 41*a* extends in parallel with the center axis of the control spool 52, the guide hole 41*a* being formed such that the guide pin 42 is slidably inserted into the guide hole 41*a*.

With this configuration, the biasing forces exerted by the support spring 20, the outer spring 51*a*, and the inner spring 51*b* are imparted to the swash plate 8 by being guided by the guide mechanism 40 in the direction along the center axis of the control spool 52. Thus, because the direction of the biasing force exerted by the outer spring 51*a* and the inner spring 51*b* acting on the control spool 52 can be set to the direction along the center axis of the control spool 52, it is possible to suppress the inhibition of the movement of the control spool 52 by the biasing force.

In addition, in the piston pump 100, the one end of the support spring 20 is moved by the tilting of the swash plate 8, and the other end of the support spring 20 is not moved by the tilting of the swash plate 8.

In addition, the piston pump 100 further includes the case 3 configured to accommodate the cylinder block 2, wherein the case 3 is formed with the support groove 3*e* in which the other end of the support spring 20 is seated, the support groove 3*e* being configured to support the support spring 20.

In addition, in the piston pump 100, the regulator 150 has the sleeve 160 attached to the attachment hole 3*f*, the attachment hole 3*f* being formed in the case main body 3*a*, and the sleeve 160 has: the seat portion 165 on which the end portion of the support spring 20 is seated; and the protruded portion 166 protruded from the seat portion 165, the protruded portion 166 being configured to support the inner circumference of the support spring 20.

With these configurations, because the other end portion of the support spring 20 is not moved by the tilting of the swash plate 8, the behavior of the extension and compression of the support spring 20 associated with the tilting of the swash plate 8 is stabilized, and it is possible to stabilize the biasing force exerted by the support spring 20.

The embodiments of the present invention described above are merely illustration of some application examples of the present invention and the technical scope of the present invention is not limited to the specific constructions of the above embodiments.

The invention claimed is:

1. A fluid pressure rotating machine comprising: a cylinder block configured to be rotated together with a driving shaft; a plurality of cylinders formed in the cylinder block, the cylinders being arranged at predetermined intervals in a circumferential direction of the driving shaft; pistons respectively inserted into the cylinders in a slidable manner, the pistons being configured to each define a capacity chamber in an interior of the cylinder; a tiltable swash plate configured to cause the pistons to reciprocate such that the capacity chambers are expanded and contracted; a tilting mechanism configured to apply a tilting mechanism biasing force against the swash plate in accordance with a supply control pressure; a support biasing member configured to support the swash plate by exerting a biasing force against the tilting mechanism biasing force; and a regulator configured to control the supply control pressure to the tilting mechanism in accordance with a discharge pressure of the fluid pressure rotating machine, wherein the regulator has a biasing member configured to be extended and compressed by following tilting of the swash plate; and a control spool configured to be moved in accordance with a biasing force from the biasing member, the control spool being configured to regulate the supply control pressure, the biasing member and the support biasing member are provided adjacent to each other, and the support biasing member is configured so as not to exert the biasing force against the control spool.

2. The fluid pressure rotating machine according to claim 1, wherein the support biasing member and the biasing member are each a coil spring, and the biasing member is provided on an inner side of the support biasing member.

3. The fluid pressure rotating machine according to claim 1, further comprising:

a guide mechanism configured to guide a biasing force imparted to the swash plate from the support biasing member and the biasing member, wherein the guide mechanism has:

a guide pin configured to transmit the biasing force from the support biasing member and the biasing member to the swash plate; and a guide hole formed such that a center axis of the guide hole extends in parallel with a center axis of the control spool, the guide hole being formed such that the guide pin is slidably inserted into the guide hole.

4. The fluid pressure rotating machine according to claim 1, wherein one end of the support biasing member is moved by the tilting of the swash plate, and other end of the support biasing member is not moved by the tilting of the swash plate.

5. The fluid pressure rotating machine according to claim 4, further comprising a housing member configured to accommodate the cylinder block, wherein the housing member is formed with a support groove in which the other end of the support biasing member is seated, the support groove being configured to support the support biasing member.

6. The fluid pressure rotating machine according to claim 4, wherein the regulator has a sleeve attached to an attachment hole, the attachment hole being formed in the housing member, and the sleeve has:

a seat portion on which the end portion of the support biasing member is seated; and a protruded portion protruded from the seat portion, the protruded portion being configured to support an inner circumference of the support biasing member.

* * * * *